United States Patent [19]

Dusenbery

[11] 4,208,019

[45] Jun. 17, 1980

[54] TURRET WINDER FOR PRESSURE-SENSITIVE TAPE

[75] Inventor: John F. Dusenbery, Montclair, N.J.

[73] Assignee: John Dusenbery Co., Inc., Randolph, N.J.

[21] Appl. No.: 932,440

[22] Filed: Aug. 10, 1978

[51] Int. Cl.[2] ..... B65H 19/26; B65H 19/30

[52] U.S. Cl. ..... 242/56 A; 242/56.9; 242/81

[58] Field of Search ..... 242/56 A, 56.9, 81, 242/56.2–56.8, 64

[56] References Cited

U.S. PATENT DOCUMENTS

| | | | |
|---|---|---|---|
| 2,620,141 | 12/1952 | Langbo | 242/81 X |
| 3,424,398 | 1/1969 | Garnier | 242/81 |
| 3,675,866 | 7/1972 | Lemke et al. | 242/81 X |
| 3,718,302 | 2/1973 | Mount et al. | 242/56.9 X |
| 3,744,730 | 7/1973 | Burnage | 242/56 A |
| 3,869,046 | 3/1975 | Gerhart | 242/56.9 X |

*Primary Examiner*—John M. Jillions
*Attorney, Agent, or Firm*—Rudolph J. Jurick

[57] ABSTRACT

Apparatus for continuously winding pressure-sensitive tape into rolls on cores carried on mandrels. The apparatus includes means for automatically inserting new cores on a mandrel positioned in the loading station and for removing the wound rolls from a mandrel positioned in the unloading station.

3 Claims, 14 Drawing Figures

TURRET WINDER FOR PRESSURE-SENSITIVE TAPE

BACKGROUND OF THE INVENTION

The invention relates to a turret winder for pressure-sensitive tape of the class disclosed in R. W. Young U.S. Pat. No. 3,472,462, issued Oct. 14, 1969.

In turret winders as made heretofore, the core-supporting mandrels are removably coupled to the turret. In order to remove the wound rolls of tape from the machine, the loaded mandrel is removed from the turret by an operator. The operator then strips the wound rolls from the mandrel and slidably inserts new cores onto such mandrel, after which he recouples the mandrel to the turret. In the case of long mandrels carrying a relatively large number of wound rolls, two operators are required to safely remove the mandrel from the machine. Thus, in a machine having a winding cycle of 50 seconds, the operators may be required to lift and carry a total weight of many tons over an eight hour work shift. This tedious and somewhat hazardous task is eliminated in a machine made in accordance with this invention as the loading of new cores onto a mandrel and the stripping of the wound rolls is done automatically without removing the mandrels from the machine. This arrangement also results in a shorter, overall winding cycle, thereby advantageously increasing the output of the machine over a given period of time.

SUMMARY OF THE INVENTION

Three cantilever mandrels are carried by a turret for indexing between loading, winding and unloading stations. The mandrels remain connected to the turret during normal operations of the machine. A carriage, arranged for automatic movement between two positions, carries a core box which has been loaded with new cores. As the carriage moves from one to another position, these cores are slidably inserted over a mandrel positioned in the loading station. During the return movement of the carriage, the wound rolls are stripped from the mandrel positioned in the unloading station and are transferred onto a platform carried by the carriage. Also carried by the carriage is a cutting knife and a brush which function to cut the tapes extending from the wound rolls and wrap the tail ends of the cut tapes smoothly onto the rolls.

An object of this invention is the provision of improved apparatus for winding tape into rolls on cores.

An object of this invention is the provision of tape-winding apparatus in which the cores into which the tape is wound are carried by cantilever mandrels.

An object of this invention is the provision of a turret winder for winding pressure-sensitive tape into rolls on cores carried by mandrels, which apparatus includes means for automatically loading new cores on one mandrel and automatically stripping wound rolls from another mandrel.

An object of this invention is the provision of turret apparatus for winding pressure-sensitive tape into wound rolls, which apparatus includes means for automatically cutting the tapes from wound rolls, for wrapping the tail ends of the cut tapes onto the wound rolls, and for removing the wound rolls from the apparatus.

The above-stated and other objects and advantages of the invention will become apparent from the following description when taken with the accompanying drawings. It will be understood, however, that the drawings are for purposes of illustration and are not to be construed as defining the scope or limits of the invention, reference being had for the latter purpose to the claims appended hereto.

BRIEF DESCRIPTION OF THE DRAWINGS

In the drawings wherein like reference characters denote like parts in the several views.

DESCRIPTION OF PREFERRED EMBODIMENT

Figure 1:
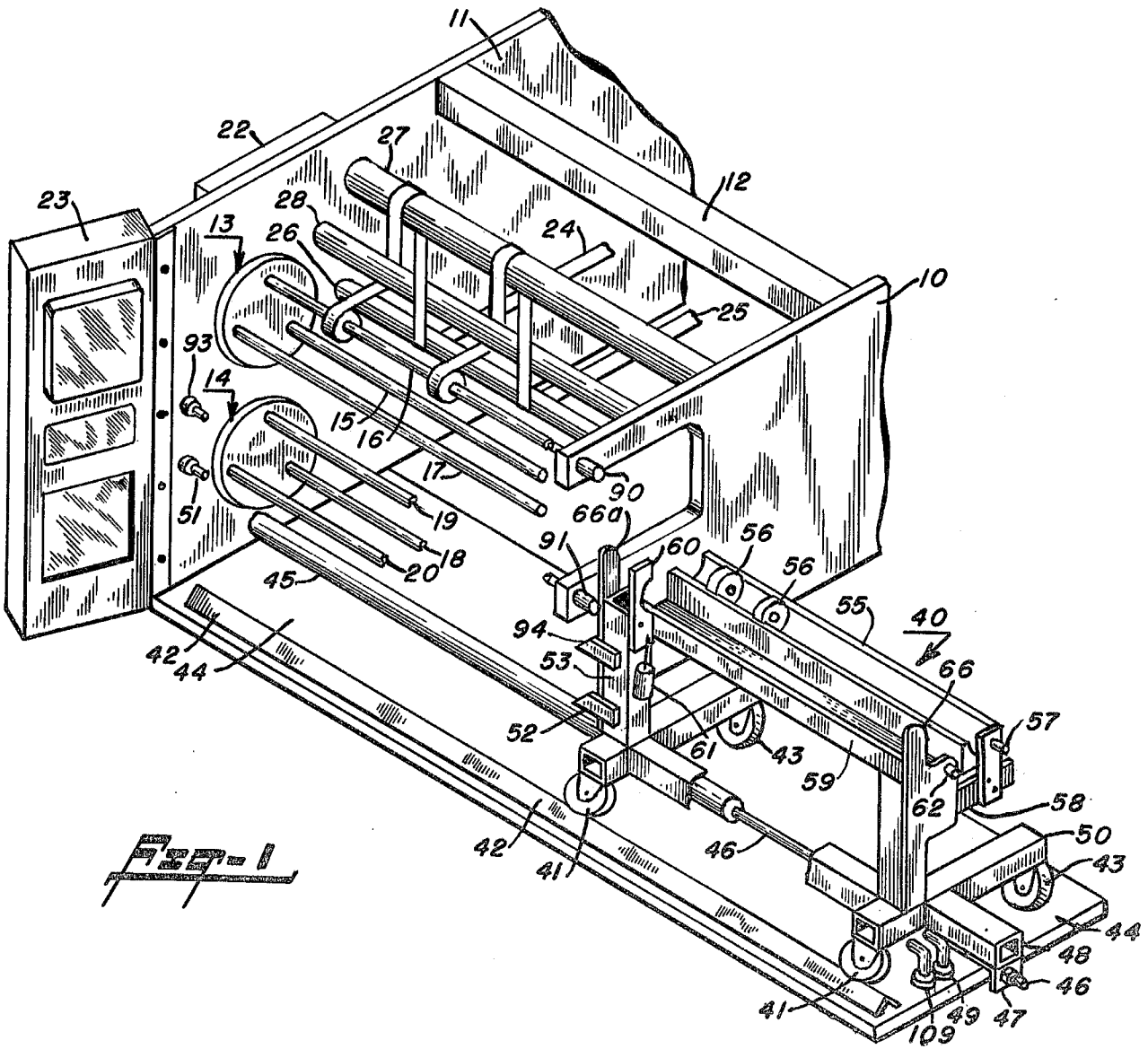
FIG. 1 is a fragmentary diagrammatic representation showing the operative relation of various components of a winding machine embodying this invention.

Reference now is made to FIG. 1 showing portions of the machine side frames 10, 11 and a cross beam 12. A pair of turrets 13 and 14 are carried by the frame 11, the upper turret 13 carrying three, cantilever mandrels 15, 16 and 17 and the lower turret 14 carrying the similar mandrels 18, 19 and 20. These mandrels can be of the conventional differential rewind type or of the conventional air-inflatable type having air valves at the free ends thereof. The turrets are operable to index the associated mandrels between loading, winding and unloading stations, by power means and controls contained in cabinets identified by the numerals 22 and 23. Specifically, the mandrels 15 and 18 are in the loading station, the mandrels 16 and 19 are in the winding station and the mandrels 17 and 20 are in the unloading station. All of the mandrels remain connected to the turrets during normal operations of the machine but they can be removed for purposes of repair. The cabinet 22 also includes drive means for rotating individual mandrels about their respective axes.

The turret winder is associated with a slitting machine which slits a relatively wide web of pressure-sensitive tape longitudinally across its width into a plurality of narrow strips. FIG. 1 shows two such strips 24 and 25. As the strips come from the slitting machine they pass around an idler roll 26, a pull roll 27 having a rubber surface, an idler roll 28 and onto cores carried by the mandrel 16 which is positioned in the winding station. During the tape-winding operation, the mandrel 16 retains the cores securely locked thereto. Although not shown in the drawing, those skilled in this art will understand that alternate strips of the cut tape are directed to the mandrels carried by the lower turret 14, as is conventional in a duplex winder.

Figure 2:
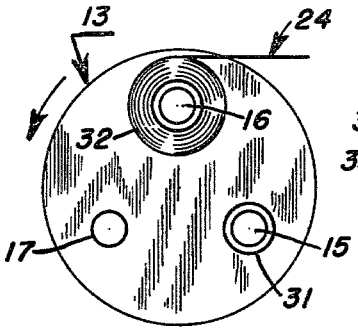
FIGS. 2–4 are fragmentary diagrammatic representations to illustrate one operating cycle of the machine.
Figure 3:
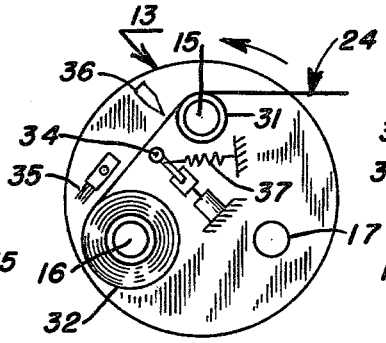
Figure 4:
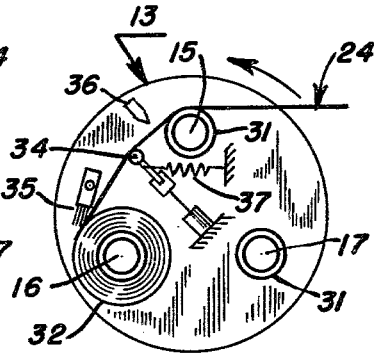
Figure 6:
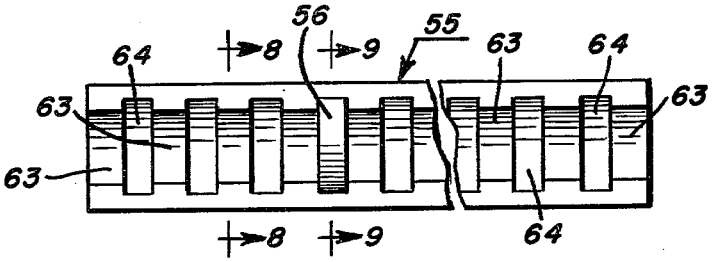
FIG. 6 is a corresponding top plan view.
Figure 7:
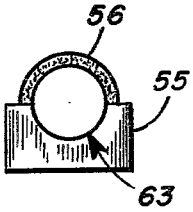
FIG. 7 is a corresponding end view.
Figure 5:
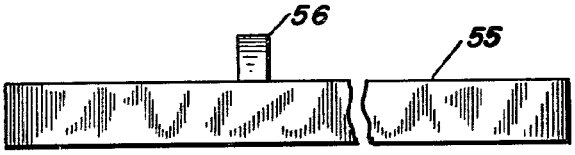
FIG. 5 is a side elevational view of the core box including a single core placed therein.
Figure 8:
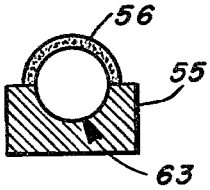
FIG. 8 and 9 are cross-sectional views taken along the lines 8—8 and 9—9, respectively, of FIG. 6.
Figure 9:
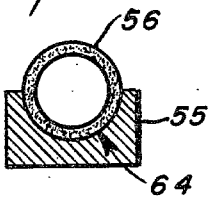

A winding cycle of the machine will be described with reference to FIGS. 2–4 which show the upper turret 13 carrying the mandrels 15, 16 and 17. In FIG. 2 the mandrel 15 is positioned in the loading station and carries a plurality of new cores, one such core being visible in this particular view and identified by the numeral 31. The tape strip 24 is being wound into a roll 32 on a core carried by the mandrel 16 positioned in the winding station. An empty mandrel 17 is in the unloading station. After the roll 32 reaches a predetermined diameter, as determined by a suitable counter responsive to roll footage, the winding operation is stopped after which the turret is indexed 120 degrees in a counter-clockwise direction, whereby the mandrels occupy the positions shown in FIG. 3. The tape strip 24 is wound with the adhesive surface on the inside of each convolution so that the tape now becomes attached to the new core 31. After the turret has been indexed, a transfer bar 34, a brush 35 and a cutting knife 36 are moved into operative positions with respect to the tape. It is here pointed out that the bar, brush and knife are carried by a carriage identified by the numeral 40 in FIG. 1. That portion of the tape which extends between the wound roll 32 and the new core 31 is made taut by the transfer bar 34 which is arranged for movement from a normal position shown in FIG. 3 to a tape-tensioning position shown in FIG. 4. At the same time, the brush 35 is pivotally moved into contact with the tape on the wound roll 32 as shown in FIG. 4. At this point in the machine operating cycle the cutting knife 36 is operated momentarily to cut the tape at a point close to the new core 31, after which the mandrel 16 is slowly rotated for about one revolution. As this mandrel begins to rotate, the trailing end of the cut tape, which is attached to the transfer bar 34, pulls the bar toward the roll 32 against the action of the spring 37. This arrangement keeps the tape end taut and in alignment with the convolutions of the wound roll so that the action of the brush 35 causes the tape end to be wound smoothly onto the roll. The brush and the transfer bar then return to the positions shown in FIG. 3. The wound roll is removed from mandrel 16 and a new core 31 is inserted over the mandrel 17 now positioned in the loading station. The machine is ready for another winding cycle.

Referring again to FIG. 1, the carriage 40 is provided with a pair of grooved wheels 41 rotatable on a guide rail 42 which is secured to a base 44, and a pair of flat surface wheels 43 rotatable on the base 44. The base 44 is secured rigidly to the machine frame members 10 and 11. A fluid cylinder 45 is secured in fixed position on the base 44 and has a piston 46 attached to a bracket 47 carried by a tubular arm 48. Operation of the fluid cylinder causes the piston to move the cariage in one or the other direction, the limits of such movement being determined by suitable limit switches controlling the connection of the cylinder to a source of fluid under pressure. Specifically, the limit switch 49, carried by the base 44, is actuated by the cross arm 50 to limit movement of the carriage in a direction away from the turrets 13 and 14. The limit switch 51, caried by the machine frame 11, is actuated by a dog 52, carried by the vertical post 53 of the carriage, to limit movement of the carriage toward the turrets. The carriage returns to the illustrated normal position during the tape winding cycle, after which a plurality of new cores are loaded into a core box 55, only two such cores 56 being shown. These cores are in axial alignment with the mandrel 15 positioned in the core-loading station. As the carriage is moved toward the turrets, the new cores slide over the mandrel 15. In accordance with one embodiment of this invention, as the carriage reaches its limit of movement, the mandrel 15 is inflated by means of an air valve 57 carried by a cross arm 58 of the carriage. This valve is provided with a conventional pin for depressing the valve in the end of the mandrel while directing air under pressure into the mandrel. This pin then is withdrawn and the mandrel remains inflated with the new cores securely locked thereto. In accordance with another embodiment of the invention, the new cores are securely locked to core adapters carried by the mandrel and arranged to function as a differential rewind system. Before the carriage is returned to its normal position, a stripper arm 60 is pivotally displaced toward the mandrel 17 by a fluid cylinder 61. Such displaced arm strips the wound rolls from the mandrel 17 as the carriage returns to its normal, illustrated position. The carriage is provided with a trough 59 into which the wound rolls fall from the free end of the mandrel. It is here pointed out that the carriage is provided with two sets of similar components, the upper set being operatively associated with the mandrels carried by the turret 13 and the lower set being operatively associated with the mandrels carried by the turret 14. For example, a core box similar to the box 55 is located on a lower level of the carriage and functions to position new cores on the mandrel 18 as the carriage moves toward the turrets.

Reference now is made to FIGS. 5–9 wherein there is shown the core box 55 containing a core 56. The inside wall of the core box is formed by two series of semi-circular channels, each channel having an axial width slightly greater than that of the core and adjacent channels having different diameters. More specifically, the channels 63 are all of the same diameter, which diameter is slightly larger than that of the mandrel upon which the cores are to be positioned. The channels 64 have uniform diameters substantially equal to the outside diameter of the core. Thus, the core box will hold a plurality of cores in axial alignment and spaced a predetermined distance apart.

Figure 10:
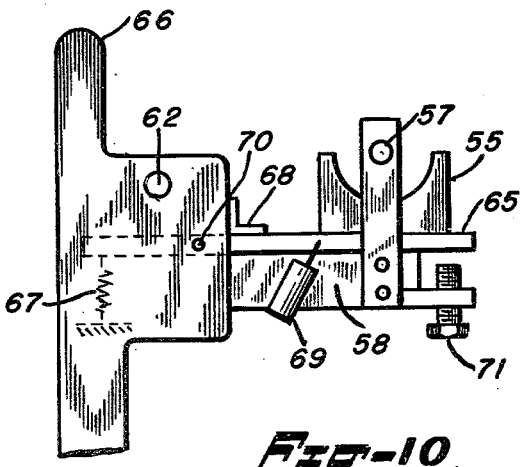
FIG. 10 is a fragmentary end elevational view of that portion of the carriage which carries the core box.

Reference now is made to the fragmentary end elevational view of FIG. 10 showing the core box 55 which is secured to a support plate 65. This plate is pivotally supported between the vertical carriage frame member 66 and the post 53, see FIG. 1, and is biased by a spring 67 against a stop 68. In this position of the core box, the cores carried by the box are in axial alignment with the mandrel positioned in the core-loading station. The mandrel will slide through the new cores as the carriage moves toward the turrets. Just prior to the carriage reaching the limit of its movement in this direction, the air valve 57 is actuated to cause inflation of the mandrel. The mandrel remains inflated to retain the cores in place until such time as the fully wound rolls of tape are to be removed from the mandrel in the unloading station. At that time, the air valve 62 is actuated (see also FIG. 1), to effect a depression of the pin in the free endof the mandrel. Before the start of the return movement of the carriage, the core box must be lowered relative to the axis of the newly-loaded mandrel so that the box will not interfere with the cores as the carriage returns to its initial position. This is done by means of the air cylinder 69 which is pivotally coupled to the support plate 65. Actuation of the cylinder 69 causes rotation of the support plate and core box about a pivot axis 70 until the plate comes into contact with an adjustable stop 71. The stop 71 is set to provide a clearance between the cores on the mandrel and the core box. De-actuation of the cylinder 69 occurs after the carriage has returned to its initial position, thereby placing the core box in position for the loading of new cores therein and for transportation of such cores toward the turrets.

Figure 12:
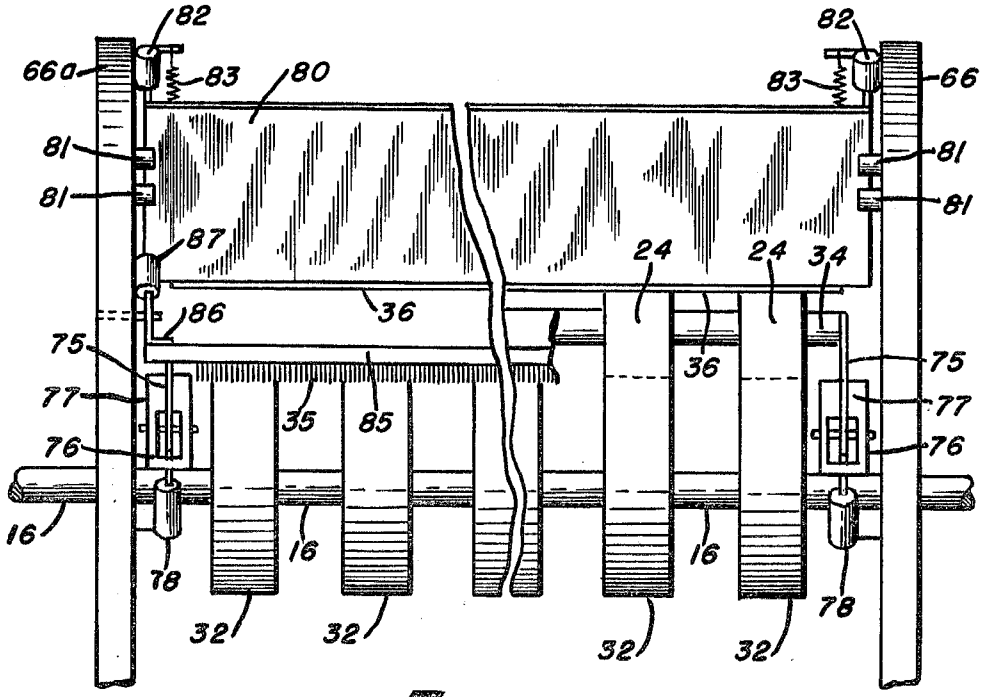
FIG. 12 is a corresponding front elevational view with a portion of the brush mechanism broken away.
Figure 11:
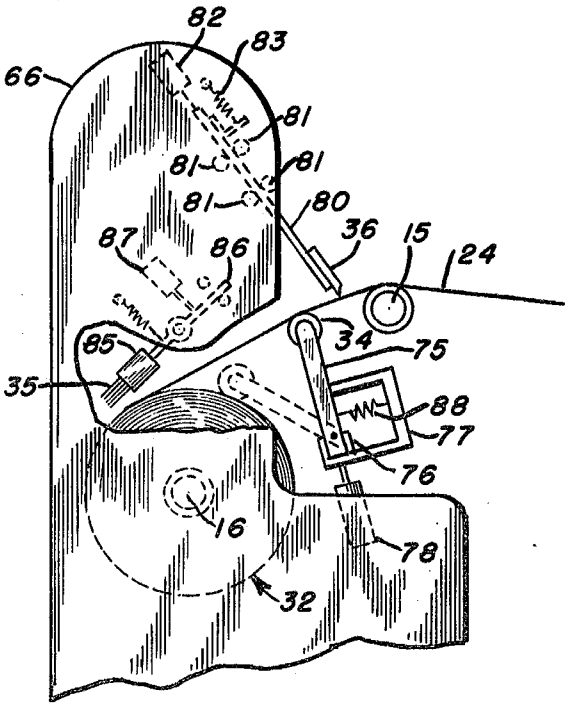
FIG. 11 is a fragmentary diagrammatic view, in end elevation, showing the mechanisms for effecting operation of the transfer bar, brush and cutting knife.

The general construction and arrangement of the transfer bar, the brush and the cutting knife will now be described with specific reference to FIGS. 11 and 12. Here are shown a plurality of wound rolls 32 carried on the mandrel 16. It is assumed the tape winding cycle has just been completed and the turret has been indexed to position the mandrel 16 in the illustrated unloading station. The tape strips 24 have now become attached to the new cores carried by the mandrel 15 which has been positioned in the winding station. The transfer bar 34 has its ends secured to arms 75. These arms are pivotally coupled to blocks 76 attached to brackets 77, which brackets are coupled to the pistons of associated air cylinders 78 secured to the carriage side frame members 66 and **66*a*. The transfer bar is disposed beneath the tape strips 24 and normally is spaced therefrom. When the cylinders are actuated the transfer bar is elevated to a point somewhat beyond the plane containing the portions of the tape strips extending between the wound rolls 32 and the new cores carried by the mandrel 15. Consequently, such portions of the tape strips are placed under tension and ready for the tape cutting operation. The cutting knife 36, preferably having a serrated cutting edge, is secured to a slide bar 80 which is guided by rollers 81 for rectilinear movement toward and away from the tape strips in response to actuation of air cylinders 82 and the action of return springs 83, respectively. Momentary actuation of these cylinders results in the cutting of all of the tape strips at points close to the new cores. The machine operator now closes a control switch to cause slow rotation of the mandrel 16 for a fraction of a turn. The brush 35 is carried by a bar 85 having ends attached to pivotally-mounted arms 86. Normally, the brush is spaced from the wound rolls as seen in FIG. 11. However, simultaneously with the start of rotation of the mandrel 16, air cylinders 87 are actuated, thereby bringing the brushes into pressure contact with the wound rolls. The trailing ends of the cut tapes adhere to the transfer bar, whereby the bar is drawn toward the wound rolls against the restraining action of springs 88, one such spring being visible in FIG. 11. This arrangement retains the trailing ends of the cut tape under tension and in alignment with the associated wound rolls, thereby resulting in smoothly wound rolls. After the completion of this particular operation, the brush and the transfer bar are returned to their normal positions and the carriage can be returned to its initial position as shown in FIG. 1. With continued reference to FIG. 1, before the return movement of the carriage is initiated, the air cylinder 61 is actuated, thereby rotating the upper portion of the stripper arm 60 toward the axis of the mandrel carrying the fully wound rolls. As the carriage moves toward its normal position, the stripper arm pushes the wound rolls along the mandrel causing them to fall, one after the other, into the trough 59**.

While the above description has been given with reference to elements and mechanisms carried by the upper part of the carriage and arranged for operative association with the mandrels carried by the upper turret, similar elements and mechanisms are carried by the lower part of the carriage for operative association with the mandrels carried by the lower turret. The core boxes, troughs, transfer bars, brushes and cutting knives are approximately equal in length to the mandrels and span the cores and wound rolls when the carriage has been moved to the limit of its travel toward the turrets.

When the machine is first placed into operation, the core boxes are loaded and the carriage is moved toward the turrets, whereby the cores slip on to the mandrels positioned in the loading stations. The core boxes are then lowered and the carriage returned to its starting position. The operator now threads the cut strips of tape around the various machine rollers and attaches each tape to a core, thereby placing the machine in condition for automatic operation. In the meantime, the core boxes are reloaded with new cores. When the mandrels are of the air inflatable type, they are inflated to lock the cores in place just after the carriage reaches the limit of its travel toward the turrets. These mandrels remain inflated until the winding operation has been completed and the wound rolls are ready to be removed from the mandrel in the unloading station. Referring to FIG. 1, the air cylinders 90 and 91 are energized and the pistons of these cylinders form end bearings for the mandrels during the tape winding operation. Also shown in FIG. 1 is an air control valve 93 which is actuated by a dog 94 and controls the connection of the mandrel inflator valves to a source of air under pressure.

Figure 13:
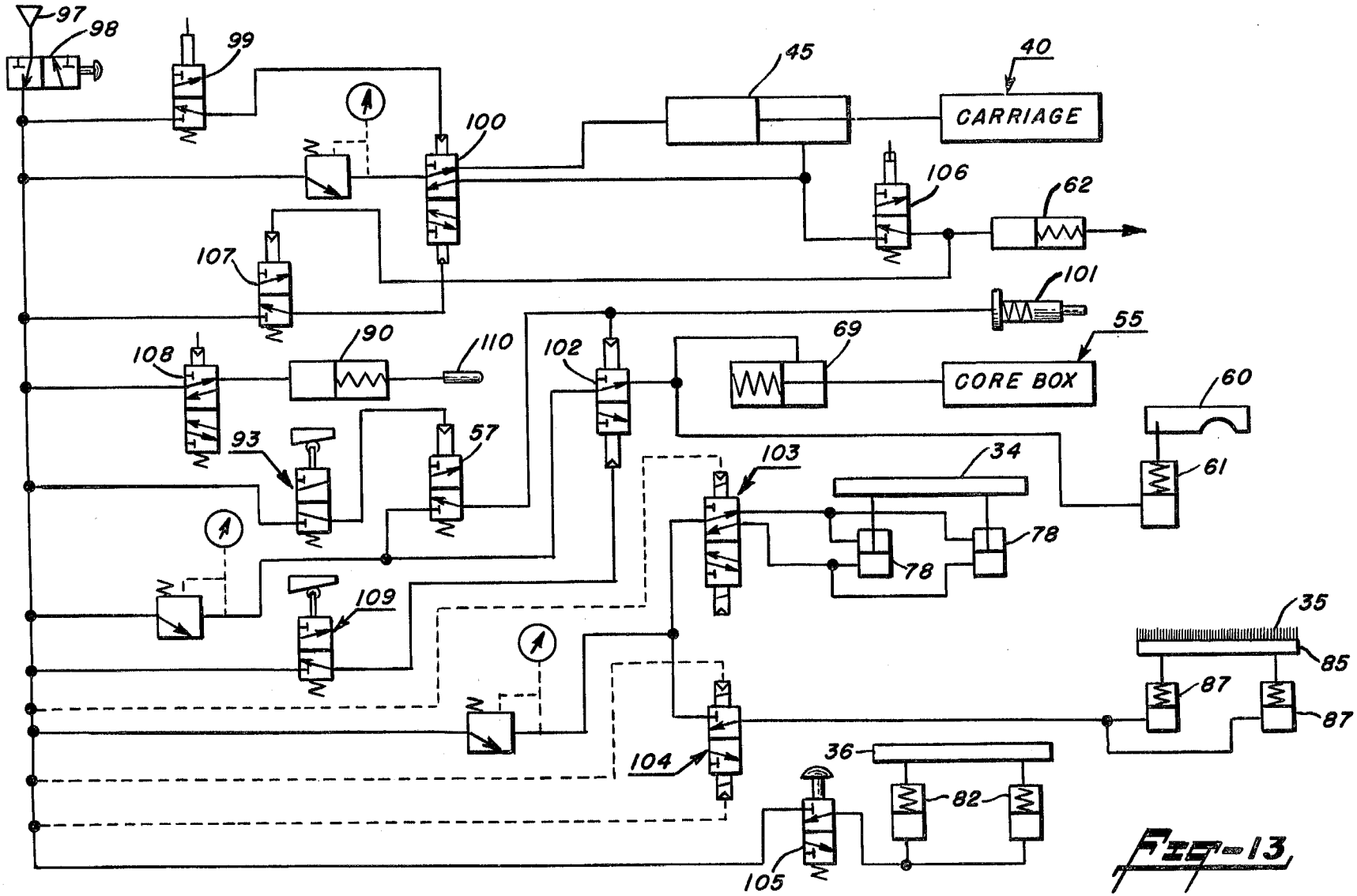
FIG. 13 is a diagram of the pneumatic control system.

Reference now is made to the pneumatic control system shown in FIG. 13 and wherein those components which have already been described are identified by the previously applied reference numerals. This figure shows only those components which are associated with the mandrels carried by the upper turret, a similar control system being provided for operation of the components associated with the lower turrent. it is assumed that the carriage is in the initial, or normal, position as shown in FIG. 1, that the core box is loaded with cores, that the brush is in the 'up' position, that the transfer bar is in the 'down' position and that the stripper arm is in the retracted position. The system is connected to an air pressure source 97 upon opening of the manually-operable valve 98. When the turret and mandrels are stationary, an electrical signal can be applied to open the solenoid valve 99, whereby air pressure is applied to the air cylinder 45, through the valve 100, to move the carriage 40 toward the turret and into operative position with respect to the mandrels. When the carriage has reached the limit of movement in this direction, it actuates a 3-way cam-actuated valve 93 which opens to provide pilot air pressure to a pilot valve 57, causing the inflator 101 to inflate the mandrel which is positioned in the loading station. After the air pressure in the inflator reaches approximately 40 pounds per square inch, the 3-way valve 102 operates to supply air to the air cylinders 61 and 69, the air cylinder 69 lowering the core box 55 and the cylinder 61 causing pivotal movement of the stripper arm 60 toward the axis of the mandrel positioned in the unloading station. After each indexing of the turret, an electrical signal is available for application to the solenoid valves 103 and 104, thereby to effect operation of these valves by the pilot air pressure. Operation of the valve 103 causes air to be applied to the air cylinders 78 to raise the transfer bar 34, while operation of the valve 104 causes air to be supplied to the air cylinders 87 to lower the brush 35 carried by the brush bar 85. A manually-operable valve 105 can now be opened, resulting in the operation of the cutting knife 36 by the air cylinders 82. The operator now can close a switch (not shown) to cause slow rotation of the mandrel which carries the wound rolls and is positioned in the unloading station. This mandrel is rotated for a fraction of a revolution so that the brush wipes the tail ends of the cut tapes smoothly onto the wound rolls. The signals now are removed from the solenoid valves 103 and 104, thereby resulting in the return of the brush and the transfer bar to their initial positions. At the same time, the solenoid valve 105 is actuated causing the air cylinder 62 to effect deflation of the mandrel positioned in the unloading station. Actuation of the valve 106 also results in the actuation of a pilot valve 107 which cuts off the air supply to the deflator cylinder 62 and, also, repositions the valve 100 to cause return of the carriage to its initial position. When the carriage reaches the limit of its movement in this direction, a cam valve 109, (FIG. 1), repositions the valve 102 so that the core box 55 is raised and the stripper arm 60 is retracted to its initial position. Closure of the limit switch 49 (FIG. 1), causes deenergization of the solenoid of valve 106, thereby returning this valve to its initial position. Each time the turret has completed an indexing cycle, an electrical signal is available for actuation of a solenoid valve 108 which supplies air pressure to the air cylinder 90 causing an end bearing 110 to move into position to support the mandrel during the tape winding operation.

Figure 14:
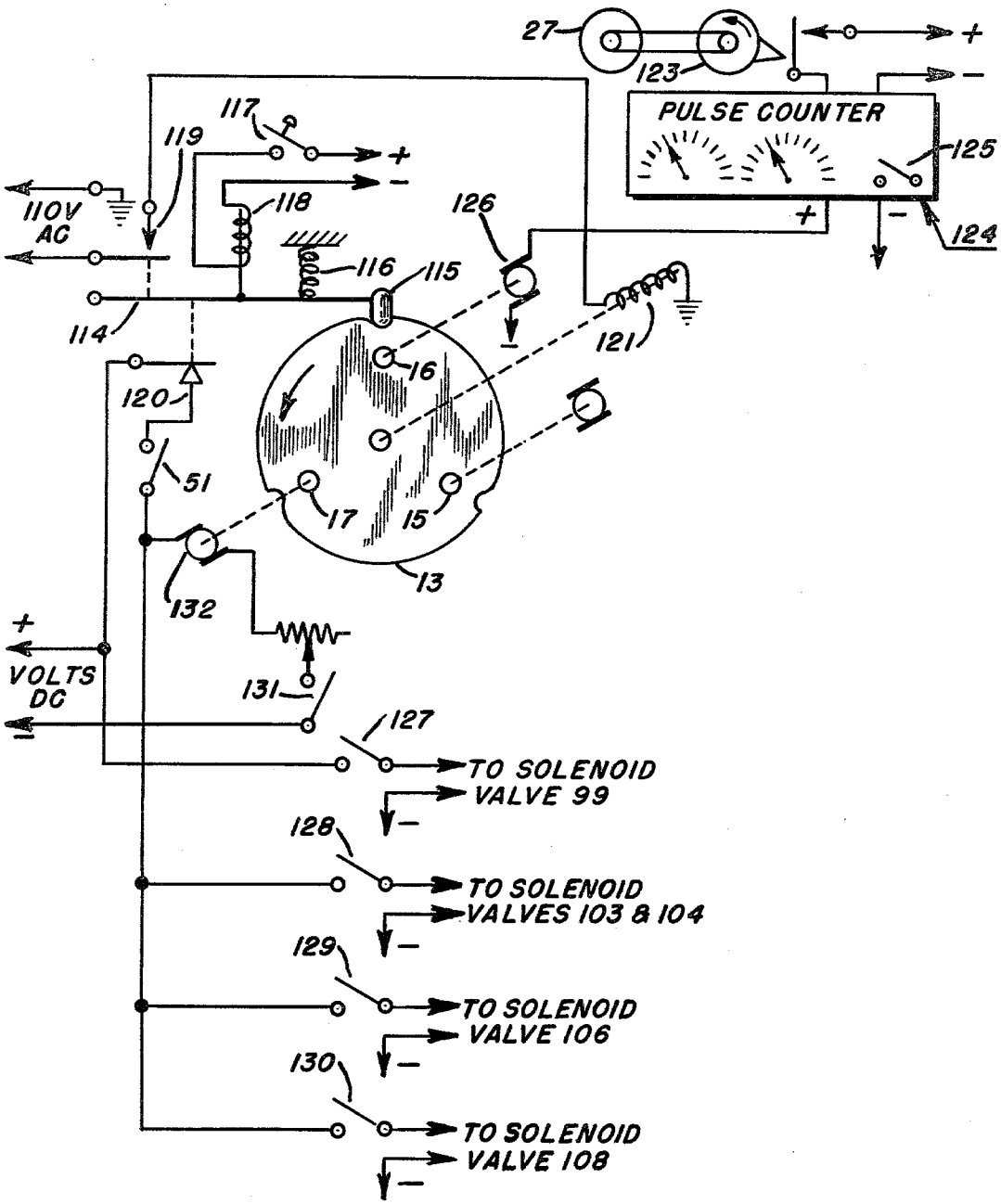
FIG. 14 is a diagrammatic representation of the electrical control system.

A schematic electrical control circuit is shown in FIG. 14 to which reference now is made. Three notches are formed in the peripheral surface of the turret 13 carrying the mandrels 15, 16 and 17. A pivotally mounted arm 114 carries a cam follower 115 normally biased into sliding engagement with the turret peripheral surface by a spring 116. To cause indexing of the turret, the operator closes the switch 117 which results in the energization of the solenoid 118 thereby raising the cam follower out of the turret notch, closing the normally-open line switch 119 and opening the normally-closed switch 120. Closure of the line switch 119 results in the energization of the drive motor 121 which rotates the turret. Shortly after the turret begins to rotate, the operator opens the switch 117, whereby the spring 116 causes the cam follower to ride upon the peripheral surface of the turret. The elevated position of the cam follower retains the line switch 119 in the closed position so that the turret continues to rotate until the cam follower falls into the next notch on the turret. At this time, the line switch opens to deenergize the drive motor 121, while the switch 120 is returned to its normally-closed position.

The arrangement for winding the tape rolls to predetermined lengths of tape comprises a rotatable disc 123 which is belt-coupled to a pulley on the pull roll of the machine, such as the roll 27 shown in FIG. 1. Each rotation of the disc applies an electrical pulse to a presetable pulse counter 124, each pulse corresponding to a fixed length of tape determined by the diameter of the pull roll and the ratio of the belt-coupled pulleys. The operator presets the pulse counter to a desired pulse count and starts the tape-winding operation by closing switch 125. Upon closure of the switch 125, the pulse counter provides a d.c. output voltage which energizes the motor 126, thereby rotating the mandrel positioned in the winding station. When the pulses accumulated in the pulse counter equal the preset valve, the switch 125 opens automatically, thereby ending the winding operation.

During the winding operation, the carriage is in its initial position as shown in FIG. 1, and the limit switch 51 is open, thereby preventing inadvertent operation of components carried by the carriage. However, the solenoid valve 99 is connected to the d.c. voltage source only through the switch 127. Thus, after the turret has been indexed to position the wound rolls in the unloading station, the operator closes switch 127 which results in movement of the carriage toward the operative position. When the carriage reaches the limit of its travel in this direction, the limit switch 51 closes and a d.c. voltage is available for operation of the various components carried by the carriage. Specifically, closure of the switch 128 results in the actuation of the solenoid valves 103 and 104 which raise the transfer bar and lower the brush, respectively. Closure of the switch 129 results in the cut off of the air supply to the deflator air cylinder and the repositioning of the valve controling directional movement of the carriage, while closure of the switch 130 results in the movement of the end bearing into engagement with the free end of the mandrel positioned in the winding station. In order to wrap the cut ends of the tapes about the wound rolls, the operator closes the switch 131 to energize the motor 132 coupled to the mandrel positioned in the unloading station.

Having now described my invention what I desire to protect by letters patent is set forth in the claims appended hereto.

I claim:

1. Apparatus for winding strips of pressure-sensitive tape into rolls on cores, said apparatus comprising, (a) a turret carrying a plurality of cantilever mandrels, (b) means for indexing the turret to position the mandrels successively in a loading, winding and unloading station, (c) a carriage supported for linear movement with respect to the mandrels, (d) drive means for selectively moving said carriage between an initial position spaced from the free ends of the mandrels and an operative position wherein the forward end of the carriage is proximate to the turret, (e) a core box carried by the carriage and arranged to support a plurality of spaced cores in axial alignment with each other and the mandrel which is positioned in the loading station, said cores being slidably inserted onto such mandrel upon movement of said carriage from the initial to the operative position, (f) means carried by said carriage and operable to lower the core box relative to the axis of the mandrel which is in the loading station, (g) a transfer bar for applying tension to the strips of tape, said transfer bar being carried by said carriage and disposed between the mandrels which are positioned in the winding and unloading station when the carriage is in the operative position, (h) means operable to displace the transfer bar laterally into engagement with the strips of tape extending between the mandrels positioned in the winding and unloading station, (i) a cutting knife carried by said carriage and disposed in a position to cut the strips of tape extending between the mandrels positioned in the winding and unloading station when the carriage is in the operative position, (j) means operable to cause the cutting knife to cut the strips of tape, (k) a pivotally-mounted brush carried by the carriage and disposed proximate to the mandrel positioned in the unloading station when the carriage is in the operative position, (l) means operable to move said brush into contact with the outer convolutions of the tape rolls carried by the mandrel positioned in the unloading station, (m) a stripper arm carried by said carriage, and (n) actuating means for moving the stripper arm into position to strip wound rolls of tape from the mandrel in the unloading station upon movement of the carriage from the operative to the initial position.

2. Apparatus as recited in claim 1, wherein the mandrels are of the air-inflatable type, and including means operable when said carriage is in the operative position for inflating the mandrel positioned in the loading station and for deflating the mandrel positioned in the unloading station.

3. Apparatus as recited in claim 1, including a receptacle carried by said carriage for receiving the wound rolls as they are stripped from the mandrel in the unloading station.

* * * * *